US008242723B2

(12) United States Patent
Green

(10) Patent No.: US 8,242,723 B2
(45) Date of Patent: Aug. 14, 2012

(54) CALCULATING AIRFLOW VALUES FOR HVAC SYSTEMS

(75) Inventor: Charles E. B. Green, Fenton, MO (US)

(73) Assignee: Nidec Motor Corporation, St. Louis, MO (US)

( * ) Notice: Subject to any disclaimer, the term of this patent is extended or adjusted under 35 U.S.C. 154(b) by 374 days.

(21) Appl. No.: 12/238,003

(22) Filed: Sep. 25, 2008

(65) Prior Publication Data

US 2009/0082908 A1 Mar. 26, 2009

Related U.S. Application Data

(60) Provisional application No. 60/995,208, filed on Sep. 25, 2007.

(51) Int. Cl.
*H02P 6/00* (2006.01)

(52) U.S. Cl. ..... 318/400.08; 318/400.09; 318/400.01; 318/700; 700/276

(58) Field of Classification Search ..... 318/400.08, 318/400.09, 400.01, 700; 700/276
See application file for complete search history.

(56) References Cited

U.S. PATENT DOCUMENTS

| | | | | |
|---|---|---|---|---|
| 5,170,344 | A | 12/1992 | Berton et al. | |
| 5,202,951 | A | 4/1993 | Doyle | |
| 5,311,451 | A * | 5/1994 | Barrett | 700/278 |
| 5,555,195 | A * | 9/1996 | Jensen et al. | 700/276 |
| 5,559,407 | A * | 9/1996 | Dudley et al. | 318/400.08 |
| 5,592,058 | A * | 1/1997 | Archer et al. | 318/400.09 |
| 5,863,246 | A * | 1/1999 | Bujak, Jr. | 454/255 |
| 5,875,109 | A * | 2/1999 | Federspiel | 700/40 |
| 6,049,739 | A * | 4/2000 | Melvin | 700/37 |

* cited by examiner

*Primary Examiner* — Walter Benson
*Assistant Examiner* — David Luo
(74) *Attorney, Agent, or Firm* — Hovey Williams LLP

(57) ABSTRACT

A method of calculating a control parameter for a component in an HVAC system includes receiving a plurality of input signals, and calculating a value of the control parameter using a control parameter equation having a plurality of predetermined coefficients and a plurality of variables, each variable corresponding to one of the input signals. This equation is stored in and subsequently fetched from memory associated with a component of the HVAC system, such as a blower motor controller or a system controller. In some embodiments, the equation is stored in a device for interfacing a system controller with a blower motor assembly.

31 Claims, 4 Drawing Sheets

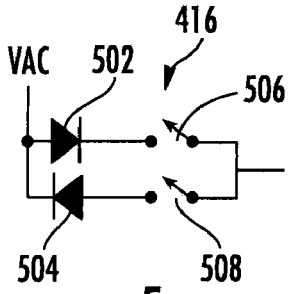
FIG. 5
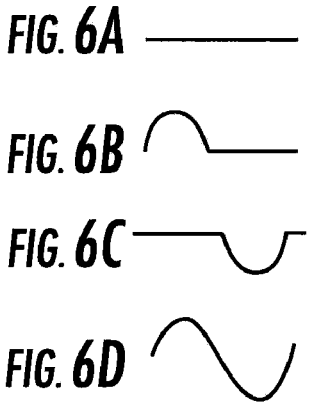
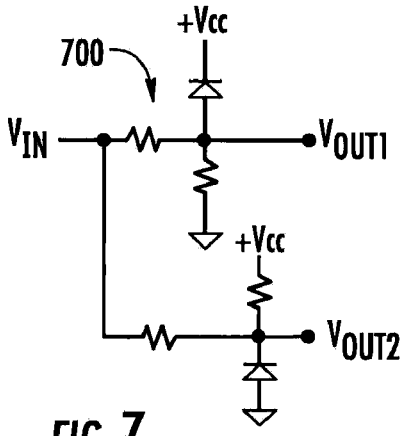
FIG. 7
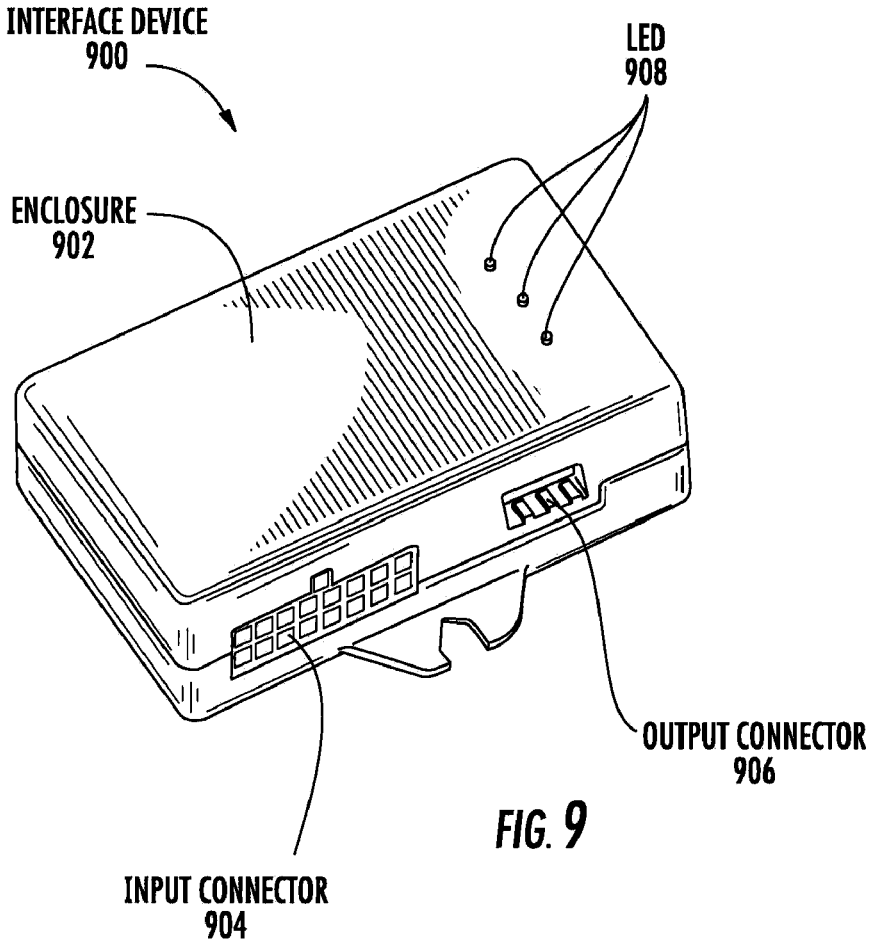
FIG. 9

CALCULATING AIRFLOW VALUES FOR HVAC SYSTEMS

CROSS-REFERENCE TO RELATED APPLICATION

This application claims the benefit of U.S. Provisional Application No. 60/995,208 filed Sep. 25, 2007, the entire disclosures of which is incorporated herein by reference.

FIELD

The present disclosure relates generally to heating, ventilating and/or air-conditioning (HVAC) systems, and particularly to calculating the value of control parameters for components in HVAC systems.

BACKGROUND

This section provides background information related to the present disclosure which is not necessarily prior art.

HVAC systems commonly include a blower motor assembly for producing airflow across heating and/or cooling elements and through the ductwork of a space being heated or cooled. The blower motor assembly typically includes a blower (also referred to as an air handler), a motor, a motor controller and memory associated with the motor controller for storing, among other things, data related to the HVAC system in which the blower motor assembly is or will be installed. During operation of the HVAC system, the blower motor assembly typically receives operating commands from a system controller in communication with a thermostat.

In many cases, the blower motor assembly is operated in a constant airflow mode. In this mode, the blower motor assembly receives various input signals, typically from the system controller. In response to these signals, and using the HVAC system data stored in its memory, the motor controller energizes the motor as necessary to produce a constant level of airflow corresponding to the received input signals.

Because the blower motor assembly is programmed for a particular HVAC system—by storing data specific to that system in the motor controller's memory—the blower motor assembly is not suitable for use in other types of HVAC systems. To address this issue, some blower motor assemblies store data for multiple HVAC systems in the motor controller's memory. When a blower motor assembly of this type is installed in a particular HVAC system, data for that particular system is selected from the motor controller's memory via operator input in the field. With this arrangement, the blower motor assembly can be used in several different HVAC systems.

As recognized by the present inventor, however, storing data for multiple HVAC systems in the motor controller's memory increases the overall memory requirements of the blower motor assembly. Furthermore, while this approach allows the blower motor assembly to be used in more than one type of HVAC system, the potential applications of the blower motor assembly are still limited to the particular HVAC systems for which data is stored in the motor controller's memory.

SUMMARY

This section provides a general summary of the disclosure, and is not a comprehensive disclosure of its full scope or all of its features.

According to one aspect of the present disclosure, a method of determining a value of a control parameter for a component in an HVAC system includes receiving a plurality of input signals and calculating the control parameter value using an equation having a plurality of predetermined coefficients and a plurality of variables with each variable corresponding to one of the input signals.

According to another aspect of the present disclosure, a method is provided for generating a control parameter equation for an HVAC system configured to receive a plurality of input signals each having at least two possible values. The method includes identifying combinations of input signal values that the HVAC system may receive, determining a desired value of the control parameter for each identified combination, and processing the identified combinations and the determined control parameter values to produce an equation having a plurality of variables and a plurality of coefficients. Each variable corresponds to one of the input signals. The equation is capable of producing the control parameter value determined for any given one of the identified combinations when that given one of the identified combinations is received by the HVAC system.

According to a further aspect of this disclosure, a device for interfacing a system controller with a component in an HVAC system includes an input for receiving a plurality of input signals each having two or more possible values, a memory device for storing a control parameter equation having a plurality of variables and a plurality of predetermined coefficients with each variable corresponding to at least one of the input signals, and a processor operably coupled to the input and the memory device. The processor is configured to calculate a value of a control parameter for a given combination of input signal values received at the input using the control parameter equation stored in the memory device.

According to yet another aspect of this disclosure, an HVAC system includes a motor assembly and a memory device storing an equation for calculating a value of a control parameter for the motor assembly in response to a plurality of input signals. The equation includes a plurality of variables each corresponding to one of the input signals.

According to still another aspect of this disclosure, a method of calculating an airflow value for a blower motor assembly in an HVAC system includes receiving a plurality of input signals, and calculating an airflow value for the HVAC system using an airflow equation having a plurality of predetermined coefficients and a plurality of variables, each variable corresponding to one of the input signals.

According to another aspect of this disclosure, a method is provided for generating an airflow equation for an HVAC system configured to receive a plurality of input signals each having at least two possible values. The method includes identifying combinations of input signal values that the HVAC system may receive, determining a desired airflow value for each identified combination, and processing the identified combinations and the determined airflow values to produce an airflow equation having a plurality of variables and a plurality of coefficients, each variable corresponding to one of the input signals. The airflow equation is capable of producing the airflow value determined for any given one of the identified combinations when said given one of the identified combinations is received by the HVAC system.

According to yet another aspect of this disclosure, a device for interfacing a system controller with a blower motor assembly in an HVAC system includes an input connector for receiving a plurality of input signals each having two or more possible values, a memory device for storing an airflow equation including a plurality of variables and a plurality of predetermined coefficients, each variable corresponding to at least one of the input signals, and a processor operably coupled to the input connector and the memory device. The processor is configured to calculate an airflow value for a given combination of input signal values received by the input connector using the airflow equation stored in the memory device.

According to still another aspect of this disclosure, an HVAC system includes a blower motor assembly for driving a blower, and a memory device storing an airflow equation for calculating an airflow value for the blower motor assembly in response to a plurality of input signals. The airflow equation includes a plurality of variables each corresponding to one of the input signals.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 5 is a schematic diagram of a diode duplexing circuit.

Figure 1:
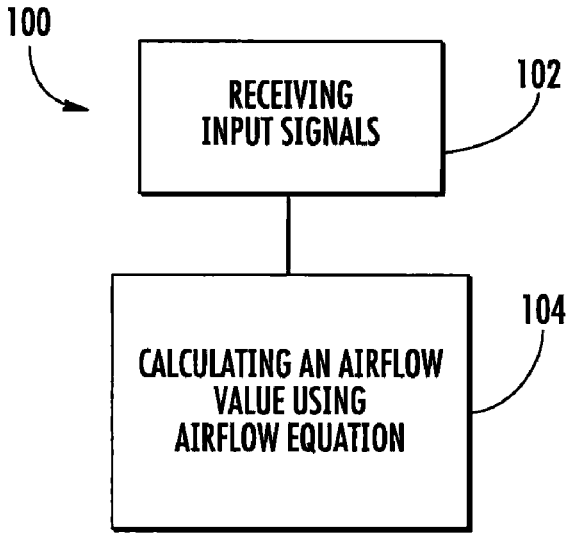
FIG. 1 is a flow diagram of a method for calculating an airflow value according to one embodiment of the present disclosure.

FIGS. 6A-D illustrate alternating waveforms produced by the diode duplexing circuit of FIG. 5.

FIG. 7 is a schematic diagram of a resistor-diode circuit for converting the alternating waveforms of FIGS. 6A-6D to binary values.

FIGS. 8A-8D are waveform diagrams illustrating output signals for the circuit of FIG. 7 in response to the input signals shown in FIGS. 6A-6D.

FIG. 9 is a perspective view of an interface device according to another embodiment of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

A method of calculating an airflow value for a blower motor assembly in an HVAC system according to one aspect of the present disclosure is illustrated in FIG. 1 and indicated generally by reference number 100. As shown in FIG. 1, the method 100 includes, at 102, receiving a plurality of input signals and, at 104, calculating an airflow value using an airflow equation. The airflow equation includes multiple predetermined coefficients and multiple variables, with each variable corresponding to one of the input signals. Thus, by inserting the values of the input signals into the airflow equation, an airflow value corresponding to these inputs can be readily generated using the method 100 of FIG. 1.

The input signals received in block 102 of FIG. 1 may be any type of signals useful in determining an airflow value for the HVAC system. In some embodiments, these input signals include configuration input signals and operating input signals. The configuration input signals are signals relating to configuration settings typically made in the field by an operator during installation of the HVAC system. For example, the value of a particular configuration input signal may indicate the type or size of a particular component employed in the HVAC system, such as the tonnage of an outdoor compressor unit. In contrast, the operating input signals are signals that change during normal operation of the HVAC system. For example, the value of a particular operating input signal may represent a call for heat or cooling. The operating input signals are typically provided by a system controller, and may include operating signals received by the system controller from a thermostat. The configuration input signals may also be provided by the system controller, particularly where the system controller includes switches or other input means for an operator to make configuration settings in the field. As will be apparent to those skilled in the art, the number of configuration input signals and/or operating signal inputs employed may vary in any given application of the method 100 of FIG. 1.

Figure 2:
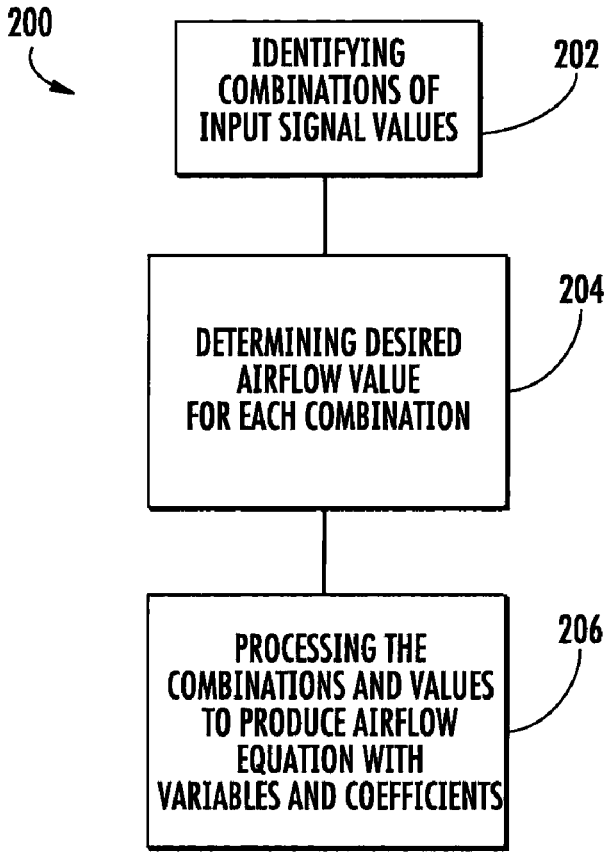
FIG. 2 is a flow diagram of a method for generating an airflow equation according to another embodiment of the present disclosure.

FIG. 2 illustrates a method 200 of generating an airflow equation for an HVAC system that is configured to receive multiple input signals each having at least two possible values. For example, one input signal may have two possible values, another input signal may have three or four possible values, etc.

As shown in FIG. 2, the method 200 includes, at 202, identifying combinations of input signal values that the HVAC system may receive. At 204, the method 200 determines a desired airflow value for each identified combination. The method 200 also includes, at 206, processing the identified combinations and the determined airflow values to produce an airflow equation having a plurality of variables and a plurality of coefficients, with each variable corresponding to one of the input signals (and each input signal corresponding to one or more variables). The airflow equation is thus capable of producing the airflow value determined for any given one of the identified combinations when said given one of the identified combinations is received by the HVAC system.

Optionally, inputs that are not digital can be treated as digital data (e.g., an input signal with two possible values is treated as a single bit, an input signal with three or four possible values is treated as two single bit inputs, etc.).

In some embodiments, block 202 of FIG. 2 will include identifying all possible combinations of input signal values that the HVAC system may receive. As should be apparent, this number of possible combinations will be a function of the number of input signals and the number of values that each input signal can take. For example, four two-state input signals can provide sixteen possible combinations of input signal values.

As should also be apparent to those skilled in the HVAC arts, the desired airflow value for a particular combination of input signal values will depend on what the input signal values represent. For example, one possible combination of input signal values may represent a call for first stage cooling in a two-stage HVAC system having a four ton outdoor compressor unit and a blower speed adjustment setting of minus ten percent (−10%). In that case, an airflow value of, e.g., 960 cubic feet per minute (CFM) may be desired and thus determined in block 204 of FIG. 2. For other possible combinations of input signal values, different (or, in some cases, the same) airflow values may be determined.

As one example implementation of the method 200 of FIG. 2, suppose an HVAC system is configured to receive four input signals IS1, IS2, IS3 and IS4 each having two possible values, such as a binary 1 or 0. In this example, block 202 of FIG. 2 may include identifying twelve (of the sixteen total) possible combinations of input signal values that the HVAC system may receive. These twelve identified combinations are set forth in Table 1 below.

TABLE 1

| Input Signal Values | | | | Airflow |
|---|---|---|---|---|
| IS1 | IS2 | IS3 | IS4 | value |
| 1 | 1 | 0 | 1 | 700 |
| 1 | 1 | 0 | 0 | 800 |
| 1 | 1 | 1 | 0 | 900 |
| 0 | 1 | 0 | 1 | 875 |
| 0 | 1 | 0 | 0 | 1000 |
| 0 | 1 | 1 | 0 | 1125 |
| 1 | 0 | 0 | 1 | 1050 |
| 1 | 0 | 0 | 0 | 1200 |
| 1 | 0 | 1 | 0 | 1350 |
| 0 | 0 | 0 | 1 | 1225 |
| 0 | 0 | 0 | 0 | 1400 |
| 0 | 0 | 1 | 0 | 1575 |

Block 204 of FIG. 2 includes determining a desired airflow value for each of the twelve identified combinations. These determined airflow values are also included in the example of Table 1. Block 206 of FIG. 2 includes processing the twelve identified combinations of input signal values, and the desired airflow values determined for each, to produce an airflow equation having multiple variables and multiple coefficients, with each variable corresponding to one of the input signals IS1, IS2, IS3, IS4. Thus, the produced airflow equation may take the following form:

$$\text{Airflow value}=1400+175*(IS3)-175*(IS4)-400*(IS2)-50*(IS2)*(IS3)+50*(IS2)*(IS4)-200*(IS1)-25*(IS1)*(IS3)+25*(IS1)*(IS4).$$

This airflow equation is capable of producing the airflow value determined for any given one of the twelve identified combinations of input signal values when that particular combination of input signal values (expressed as ones and zeros) is received by the HVAC system and inserted into the airflow equation. For example, if the input signals IS1, IS2, IS3 and IS4 have binary values of 0-1-0-1, respectively, inserting these values into the airflow equation above will produce a desired airflow value of 875 CFM, in keeping with Table 1.

In this and other embodiments, the produced airflow equation includes multiple terms, several of which include multiple variables. For example, the fifth term in the airflow equation above includes variables IS2 and IS3, and a coefficient value of fifty (50). Although the equation above includes nine terms with each term including, at most, only two variables and each variable having only two possible values (i.e., a one or zero), it should be understood that, in other embodiments, the airflow equation may include many more (or less) terms, several terms may include more or less than two variables, and some variables may have more than two possible values. Further, the number of input signals received by the HVAC system, and the number of variables employed in the airflow equation, may be more or less than in the example above. In general, the complexity of the airflow equation will depend on the number of identified combinations of input signals values and the corresponding desired airflow values. In many embodiments, the processing 206 of FIG. 2 includes processing the identified combinations of input signal values and the desired airflows values determined for each using one or more mathematical software tools, such as MATLAB® and/or Mathematica®. Alternatively, such processing can be performed manually.

As an example, if there are only two input signals IS1, IS2 each having two possible values, the airflow equation could have up to four possible terms and could take the following form:

$$\text{Airflow value}=K_0+K_1(IS1)+K_2(IS2)+K_3(IS1)(IS2).$$

By using each possible combination of input signal values and the desired airflow value for each combination, a set of simultaneous equations can be written and solved to determine values for the coefficients $K_0$, $K_1$, $K_2$ and $K_3$ in the airflow equation above. This same approach (or other approaches) can be used to produce a suitable airflow equation for any given application of this disclosure, regardless of the number of input signals and/or the number of possible values for each input signal.

The airflow equation employed in the method 100 of FIG. 1 can be generated using the method 200 of FIG. 2 or any other suitable method. Using an airflow equation to calculate an airflow value for an HVAC system can simplify the determination of the airflow value, and may require less memory, as compared to using lookup tables or selecting and retrieving specific parameters from the motor controller's memory in response to user input signals.

The airflow equation can be implemented by any suitable component of the HVAC system including, for example, the system controller and the blower motor assembly. In some embodiments, the airflow equation is implemented by an interface device that interfaces the system controller with the blower motor assembly, as further described below.

Figure 3:
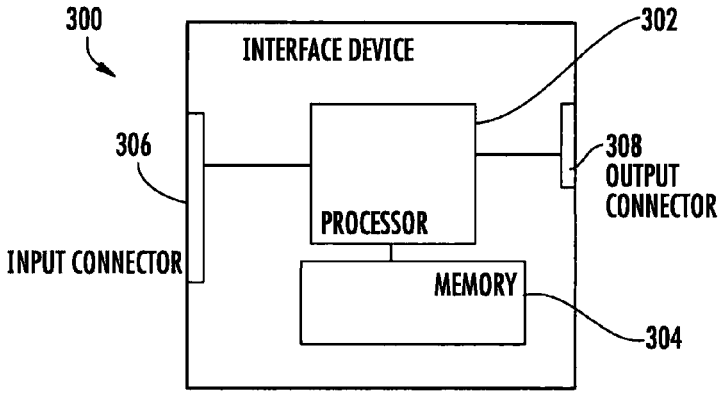
FIG. 3 is a block diagram of an interface device according to another embodiment of the present disclosure.

FIG. 3 illustrates one embodiment of such an interface device 300. As shown therein, the interface device 300 includes a processor 302, a memory device 304, an input connector 306 and an output connector 308. The input connector 306 is provided for receiving multiple input signals each having two or more possible values. An airflow equation having multiple variables and multiple predetermined coefficients is stored in the memory device 304. Each variable in the airflow equation corresponds to at least one of the input signals. The processor 302 is coupled to the input connector 306, the memory device 304 and the output connector 306. Further, the processor 302 is configured to calculate an airflow value for a given combination of input signals received at the input connector 306 using the airflow equation stored in the memory device 304.

Although the embodiment of FIG. 3 employs an input connector 306 and an output connector 308, it should be understood that one or more wireless inputs and/or wireless outputs (i.e., without connectors) can be used in a given application of the present disclosure. Further, although the embodiment of FIG. 3 (and other embodiments discussed herein) employs a processor and memory for implementing an airflow equation, the airflow equation could, alternatively, be implemented using hard-coded logic (e.g., using an ASIC, stand alone ICs, etc.)

The memory device 304 is preferably a programmable non-volatile memory device such as an electrically erasable programmable read only memory (EEPROM). The memory device 304 can be external to the processor 302, as shown in FIG. 3, or embodied (as on-board memory) within the processor 302. The processor 302 can be a microprocessor, a microcontroller, a digital signal processor (DSP) or any other suitable processing device.

When the interface device 300 is used in an HVAC system, the processor 302 fetches the airflow equation from the memory device 304. The processor 302 also inserts the values of specific input signals, received via the input connector 306, into the corresponding variables of the airflow equation and calculates the airflow value for the given combination of input signal values. The interface device 300 can then provide the calculated airflow value to a blower motor assembly via the output connector 308.

As noted above, the number of terms and variables employed in the airflow equation, as well as the values of the predetermined coefficients, are typically determined based on the particular HVAC system(s) in which the interface device 300 will be used. In this manner, the interface device 300 can be programmed for one or more particular HVAC systems via the airflow equation stored in the memory device 304. In many cases, this will eliminate any need to store HVAC system data in the blower motor assembly. As a result, a generic blower motor assembly can be used in a wide variety of HVAC systems. For example, a blower motor assembly having a ½ horsepower motor can be used with an appropriate interface device in virtually any HVAC system requiring up to a ½ horsepower blower motor. This is in contrast to, for example, using multiple different ½ horsepower blower motor assemblies with each programmed for a different HVAC system or group of HVAC systems.

Figure 4:
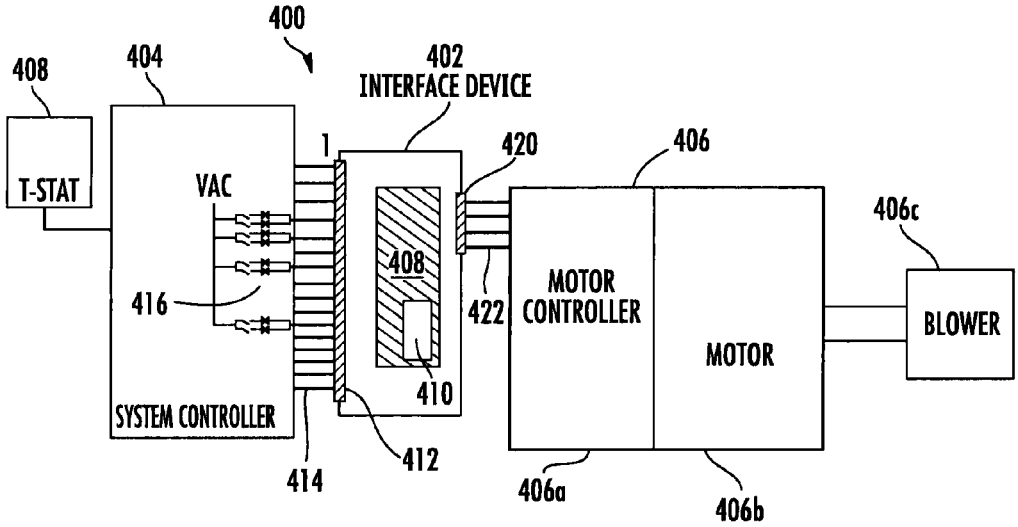
FIG. 4 is a block diagram of an HVAC system employing an interface device of the type shown in FIG. 3.
Figure 8A:
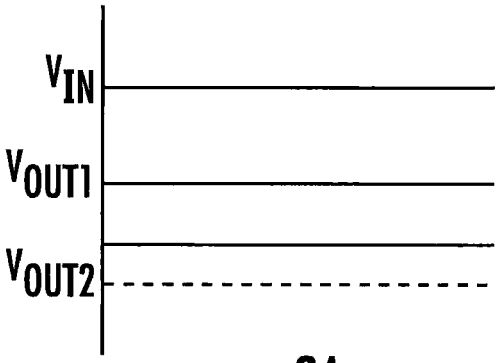
Figure 8B:
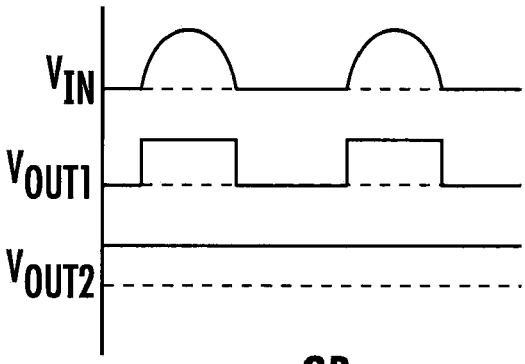
Figure 8C:
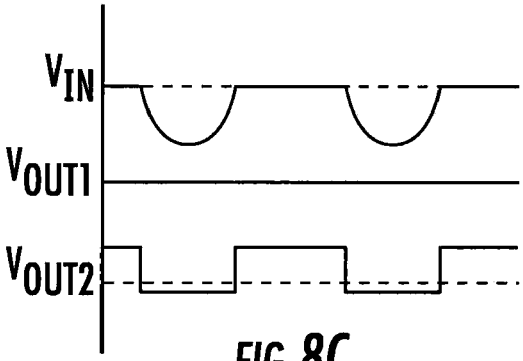
Figure 8D:
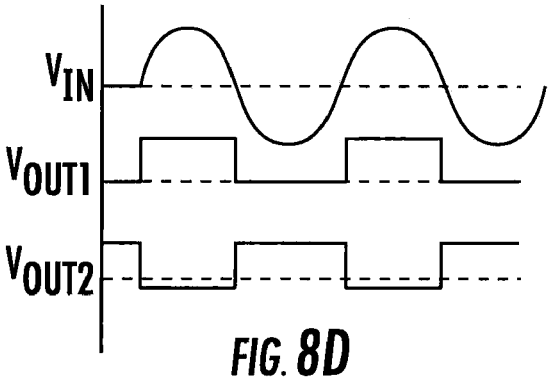

FIG. 4 illustrates one embodiment of an HVAC system 400 employing an interface device of the type described above. As shown in FIG. 4, the HVAC system 400 includes an interface device 402, a system controller 404, a blower motor assembly 406 (including a motor controller 406*a*, an electric motor 406*b* and a blower 406*c*), and a thermostat 408. The interface device 402 includes a microprocessor 408 having an on-board EEPROM 410 storing an airflow equation having multiple terms, variables and predetermined coefficients. In this particular embodiment, the interface device 402 includes a sixteen pin input connector 412 for receiving input signals from (and outputting certain signals to) the system controller 404 via a sixteen wire communication cable 414. The interface device 402 also includes an output connector 420 for communicating with the blower motor assembly via a four wire communication cable 422.

The types of signals provided at the pins of the input connector 412 in this particular HVAC system 400 are indicated in Table 2, below.

TABLE 2

| Pin | Signal Name | Signal Description |
|---|---|---|
| 1 | C1 | Circuit Common |
| 2 | W/W1 | Heat/Heat 1 |
| 3 | C2 | Circuit Common |
| 4 | DELAY | Delay Select |
| 5 | COOL | Cool Select |
| 6 | Y1 | Cool 1 |
| 7 | ADJUST | Adjust Select |
| 8 | Out− | Talk Back Signal Common |
| 9 | O | Reversing Valve |
| 10 | BK/PWM | Enable/PWM |
| 11 | HEAT | Heat Select |
| 12 | R | 24 VAC Power Input |
| 13 | EM/W2 | Emergency/Heat 2 |
| 14 | Y/Y2 | Cool/Cool 2 |
| 15 | G | Fan |
| 16 | Out+ | Talk Back Signal |

More specifically, the C1 and C2 pins are used as ground connections for a 24 VAC input power; the W/W1 signal is used to represent a call for low heat; the DELAY signal represents the amount of time the blower motor assembly 406 should delay starting when a heating or cooling operation is commenced, or delay stopping after a heating or cooling operation is concluded; the COOL signal represents the airflow level for a cooling operation; the Y1 signal represents a call for low cooling; the ADJUST signal represents a trim control for adjusting the blower speed based on conditions such as humidity, etc.; the Out− signal is a talk back signal common; the O signal represents the presence or absence of a refrigerant reversing valve in a heat pump system; the BK/PWM signal indicates a percent multiplier for the airflow level selected by other inputs; the HEAT signal represents one or more heating operation configurations; the R is the 24 vac supply from a low voltage HVAC transformer; the EM/W2 signal represents a call for high heating; the Y/Y2 signal represents a call for high cooling; the G signal represents a call for blower operation; and the Out+ signal represents a talk back signal and can be used, for example, to flash an LED in a manner indicative of the blower motor's speed.

In this particular embodiment, each of the following input signals correspond to one or more variables in the airflow equation: HEAT, COOL, ADJUST, W/W1, Y1, O, BK, EM/W2, Y/Y2 and G. Of these, the following input signals are configuration signals relating to configuration settings made during installation or startup of the HVAC system 400: HEAT, COOL and ADJUST. The following other signals are operating input signals that change during normal operation of the HVAC system 400: W/W1, Y1, O, BK, EM/W2, Y/Y2 and G. The BK/PWM signal is generated by the thermostat 408 and provided to the interface device 402 via the system controller 404, typically as a 24 VAC or a pulse width modulated (PWM) signal.

In the embodiment of FIG. 4, the DELAY signal does not correspond to any particular variable in the airflow equation. Instead, the DELAY signal indicates the amount of time the blower motor assembly 406 should delay start-up after receiving a call for heating/cooling, or continue to operate after a call for heating or cooling has ended. This delay time is communicated to the blower motor assembly 406 by the interface device 402 together with the airflow value calculated using the airflow equation.

In the HVAC system 400 of FIG. 4, the configuration input signals (and the DELAY input signal) are generated by four diode duplexing circuits 416 on the system controller 404. Each diode duplexing circuit 416 provides one of four possible alternating signals (shown in FIGS. 6A-6D) to the interface device 402 via the communication cable 414. The interface device 402 converts these alternating signals to digital signals, as further described below.

As best shown in FIG. 5, each diode duplexing circuit 416 includes two switches 506, 508. The positions of these switches 506, 508 represent configuration settings typically made in the field by an installer during installation or setup of the HVAC system 400. Further, each diode duplexing circuit 416 includes two diodes 502, 504. One side of each switch is coupled to one of the diodes 502, 504, with the other sides of the switches coupled together and to one of the pins of the input connector 412 via the communication cable 414.

As illustrated in FIG. 5, an alternating signal VAC is applied to the input of each diode duplexing circuit 416. The waveform provided at the output of the diode duplexing circuit 416 depends on the positions of the switches 506, 508. When both switches 506, 508 are open, a zero signal is produced as illustrated in FIG. 6A. When switch 506 is open and switch 508 is closed, a positive half-wave signal is produced as illustrated in FIG. 6B. When switch 506 is closed and switch 508 is open, a negative half-wave signal is produced as illustrated in FIG. 6C. When both switches 506, 508 are closed, a full wave signal is produced as illustrated in FIG. 6D.

FIG. 7 illustrates a resistor-diode circuit 700 for converting an alternating signal received at its input (as an input signal Vin) from one of the diode duplexing circuits 416 into digital output signals Vout1, Vout2. Although only one circuit 700 is shown in FIG. 7, it should be understood that, in the embodiment of FIG. 4, a separate circuit 700 is provided in the interface device 402 for each of the four diode duplexing circuits 416. FIGS. 8A-8D illustrate the digital output signals Vout1, Vout2 produced for the waveforms shown in FIGS. 6A-6D. Alternatively, other means can be employed for processing the alternating signals shown in FIGS. 6A-6D, or for converting the alternating signals to digital signals.

The microprocessor 408 in the interface device 402 inserts the binary values produced by each resistor circuit 700 into corresponding variables in the airflow equation, in addition to using other input signals provided to the interface device 402, to calculate an airflow value. The calculated airflow value is then provided to the blower motor assembly 406 via the output connector 420 and the four wire communication cable 422. In response, the blower motor assembly 406 produces a level of airflow in the HVAC system 400 corresponding to the calculated airflow value.

FIG. 9 illustrates another embodiment of an interface device 900 according to the present disclosure. The interface device 900 includes a housing 902, an input connector 904, and an output connector 906. The interface device 900 further includes an airflow equation implemented in a programmable logic device (PLD) (not shown). The interface device 900 further includes light emitting diodes (LEDs) 908 to indicate the operating status of the interface device 900 or another HVAC component. For example, one or more of the LEDs 908 may be used to convey the airflow value provided to a blower motor assembly (e.g., the number of LED flashes per minute times one hundred equals the airflow value).

While various embodiments relating to calculating airflow values for blower motor assemblies are described above, it should be understood that the teachings of the present disclosure are not so limited. On the contrary, the present teachings can be employed to determine the value of other types of control parameters (in addition to airflow values) for other types of components (in addition to blower motor assemblies) in HVAC systems. For example, the present teachings can be used to determine airflow, speed, torque, current, voltage, temperature limit, and other control parameter values for blower motor assemblies as well as other types of motor assemblies including compressor, condenser fan and draft inducer motor assemblies, etc.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method of calculating an airflow value for a blower motor assembly in an HVAC system, the method comprising:

receiving a plurality of input signals; and calculating an airflow value for the HVAC system using an airflow equation having a plurality of predetermined coefficients and a plurality of variables, each variable corresponding to one of the input signals, the airflow equation being the sum of a plurality of terms, wherein a first term of the airflow equation is a first coefficient and the remaining terms include the product of a coefficient other than the first coefficient and one or more variables and the terms of the airflow equation do not include a speed of a motor associated with the blower motor assembly.

2. The method of claim 1, wherein the plurality of input signals include a plurality of configuration input signals.

3. The method of claim 2, wherein the plurality of configuration input signals include HEAT, COOL and ADJUST input signals.

4. The method of claim 2, wherein the plurality of input signals include a plurality of operating input signals.

5. The method of claim 4, wherein the plurality of operating input signals are selected from the group consisting of W/W1, Y1, 0, BK, EM/W2, Y/Y2 and G input signals.

6. The method of claim 1, wherein the HVAC system includes at least one memory device, the method further comprising storing the airflow equation in the memory device.

7. The method of claim 6, wherein calculating includes fetching the airflow equation from the memory device.

8. The method of claim 7, wherein the HVAC system includes a system controller and an interface device for interfacing the system controller with the blower motor assembly, the interface device including said memory device.

9. The method of claim 1, further comprising implementing the airflow equation in programmable logic.

10. The method of claim 1, wherein receiving includes receiving at least one of the input signals as an alternating current signal and converting the received alternating current signal to a binary value, and wherein calculating includes using said binary value as the value of one or more corresponding variables in the airflow equation.

11. The method of claim 10, wherein receiving further includes receiving at least one of the input signals as an alternating current signal from one or more switches having field selectable positions.

12. A method of generating an airflow equation for an HVAC system, the HVAC system configured to receive a plurality of input signals, the method comprising:

identifying combinations of input signal values that the HVAC system may receive;

determining a desired linear airflow value for each identified combination; and processing the identified combinations and the determined airflow values to produce an airflow equation having a plurality of variables and a plurality of coefficients, each variable corresponding to one of the input signals, the airflow equation being the sum of a plurality of terms and being capable of producing the airflow value determined for any given one of the identified combinations when said given one of the identified combinations is received by the HVAC system, wherein a first term of the airflow equation is a first coefficient and the remaining terms include the product of a coefficient other than the first coefficient and one or more variables and the terms of the airflow equation do not include a speed of a motor associated with the blower motor assembly.

13. The method of claim 12, further comprising storing the airflow equation in a memory device.

14. The method of claim 13, wherein the HVAC system includes a system controller, a blower motor assembly, and an interface device for interfacing the system controller with the blower motor assembly, and wherein the interface device includes said memory device.

15. The method of claim 12, wherein processing includes using a mathematical software tool to produce the airflow equation.

16. A device for interfacing a system controller with a blower motor assembly in an HVAC system, the interface device comprising:

an input for receiving a plurality of input signals, each input signal having two or more possible values;

a memory device for storing an airflow equation, the airflow equation including a plurality of variables and a plurality of predetermined coefficients, each variable corresponding to at least one of the input signals, the airflow equation being the sum of a plurality of terms, wherein a first term of the airflow equation is a first coefficient and the remaining ten is include the product of a coefficient other than the first coefficient and one or more variables and the terms of the airflow equation do not include a speed of a motor associated with the blower motor assembly; and a processor operably coupled to the input and the memory device, the processor configured to calculate an airflow value for a given combination of input signal values received by the input using the airflow equation stored in the memory device.

17. The interface device of claim 16, wherein the processor is a microprocessor and the memory device is an EEPROM within the microprocessor.

18. The interface device of claim 16, wherein at least one of the input signals may be received as an alternating current signal, the interface device further comprising a circuit for converting the alternating current signal to a digital signal.

19. The interface device of claim 16, further comprising an output connector for providing the calculated airflow value to the blower motor assembly.

20. The interface device of claim 19, wherein said input includes an input connector.

21. The interface device of claim 16, further comprising at least one visual indicator for indicating an operating status of the interface device.

22. An HVAC system comprising:

a blower motor assembly for driving a blower; and a memory device storing an airflow equation for calculating an airflow value for the blower motor assembly in response to a plurality of input signals, the airflow equation including a plurality of variables and a plurality of predetermined coefficients, each variable corresponding to at least one of the input signals, the airflow equation being the sum of a plurality of terms, wherein a first term of the airflow equation is a first coefficient and the remaining terms include the product of a coefficient other than the first coefficient and one or more variables and the terms of the airflow equation do not include a speed of a motor associated with the blower motor assembly.

23. The HVAC system of claim 22, further comprising a plurality of switches having field selectable positions for providing at least some of the input signals.

24. The HVAC system of claim 23, further comprising a system controller, the system controller including said plurality of switches.

25. The HVAC system of claim 24, wherein the system controller is configured for providing the plurality of input signals including a plurality of configuration input signals and a plurality of operating input signals.

26. The HVAC system of claim 25, further comprising an interface device for interfacing the system controller with the blower motor assembly, the interface device including said memory device storing the airflow equation.

27. An HVAC system comprising:

a motor assembly; and a circuit configured to implement an equation for calculating a value of a control parameter for the motor assembly in response to a plurality of input signals, the equation including a plurality of variables and a plurality of predetermined coefficients, each variable corresponding to at least one of the input signals, the airflow equation being the sum of a plurality of terms, wherein a first term of the airflow equation is a first coefficient and the remaining terms include the product of a coefficient other than the first coefficient and one or more variables and the terms of the airflow equation do not include a speed of a motor associated with the blower motor assembly.

28. The HVAC system of claim 27, wherein the circuit includes an integrated circuit (IC).

29. The HVAC system of claim 28, wherein the integrated circuit is an application specific integrated circuit (ASIC).

30. A method of calculating an airflow value for a blower motor assembly in an HVAC system, the method comprising:

receiving a plurality of input signals; and calculating an airflow value for the HVAC system using an airflow equation having a plurality of predetermined coefficients and a plurality of variables, each variable corresponding to one of the input signals, wherein a first term of the airflow equation is a first coefficient and the remaining terms include the product of a coefficient other than the first coefficient and one or more variables and the terms of the airflow equation do not include a speed of a motor associated with the blower motor assembly.

31. A method of generating an airflow equation for an HVAC system, the HVAC system configured to receive a plurality of input signals, the method comprising:

identifying combinations of input signal values that the HVAC system may receive;

determining a desired airflow value for each identified combination; and processing the identified combinations and the determined airflow values to produce an airflow equation having a plurality of variables and a plurality of coefficients, each variable corresponding to one of the input signals, the airflow equation capable of producing the airflow value determined for any given one of the identified combinations when said given one of the identified combinations is received by the HVAC system, wherein a first term of the airflow equation is a first coefficient and the remaining terms include the product of a coefficient other than the first coefficient and one or more variables and the terms of the airflow equation do not include a speed of a motor associated with the blower motor assembly.

* * * * *